US005531540A

United States Patent [19]

Wasserstrom et al.

[11] Patent Number: 5,531,540

[45] Date of Patent: Jul. 2, 1996

[54] REINFORCEMENT SYSTEM FOR HIGHWAY BARRIERS

[75] Inventors: David E. Wasserstrom, Elkins Park; Stuart S. Ostroff, Abington, both of Pa.

[73] Assignee: Yew Corporation, Wilkes-Barre, Pa.

[21] Appl. No.: 372,286

[22] Filed: Jan. 13, 1995

[51] Int. Cl.[6] ..... E01F 13/00

[52] U.S. Cl. ..... 404/6; 404/9; 256/13.1

[58] Field of Search ..... 404/6, 9, 10; 256/1, 256/13.1

[56] References Cited

U.S. PATENT DOCUMENTS 4,773,629 9/1988 Yodock ..... 256/13.1
4,946,306 8/1990 Yodock ..... 404/6
5,054,954 10/1991 Cobb et al. ..... 404/9
5,123,773 6/1992 Yodock ..... 404/6

*Primary Examiner*—William P. Neuder
*Assistant Examiner*—Pamela A. O'Connor
*Attorney, Agent, or Firm*—Lerner, David, Littenberg, Krumholz & Mentlik

[57] ABSTRACT

A reinforcement system for highway barriers comprising a frame structure mounted on the surface of an associated highway barrier and force distributing members that are adapted to distribute forces along a horizontal direction upon impact of a vehicle into the associated highway barrier so as to lessen the degree of force applied to the highway barrier and to thus provide additional strength to the associated highway barrier.

33 Claims, 7 Drawing Sheets

REINFORCEMENT SYSTEM FOR HIGHWAY BARRIERS

FIELD OF THE INVENTION

The present invention relates to reinforcement systems for highway barriers. More particularly, the present invention relates to a reinforcement system for highway barriers which can be used to effectively distribute and transfer forces away from and along a highway barrier, which may occur upon impact of a vehicle upon which the reinforcement system is mounted.

BACKGROUND OF THE INVENTION

The use of highway barriers have proven to be effective at reducing the number of serious injuries and fatalities caused by automobile accidents. Highway barriers have also proven to be effective at reducing damage which would otherwise occur to vehicles that became displaced from their proper path along a roadway.

Notwithstanding the proven usefulness and effectiveness of highway barriers, continuing safety concerns have prompted manufacturers of highway barriers to continue to exert great efforts to develop improved highway barriers which will further reduce the risk of injury to occupants of vehicles and damage to the vehicles.

To this end, particularly effective highway barriers are disclosed in U.S. Pat. Nos. 5,123,773; 4,946,306; and 4,773,629. These patents disclose highway barriers which comprise a longitudinally extending container made of semi-rigid plastic material which is self-supporting and which has a predetermined shape. When the highway barriers disclosed in these patents are filled with water, or other fluid substance such as sand, chipped rubber and the like, the weight of the associated highway barriers is substantially increased and the shape is maintained. The highway barriers disclosed in these patents can be interconnected to form a continuous barrier wall.

Although the design of the highway barriers disclosed in the aforementioned patents has been shown to be superior over conventional highway barriers, a need continues to exist for a reinforcement system for use in connection with highway barriers which will transfer forces away from the highway barriers upon impact of a vehicle and which will distribute the forces in such a manner so that the support strength of an associated highway barrier system is enhanced. Such an improved system will prevent heavy vehicles, or vehicles driven at great rates of speed, from crashing through a continuous line of highway barriers.

SUMMARY AND OBJECTS OF THE INVENTION

The present invention addresses the aforementioned needs by providing a reinforcement system for highway barriers. In accordance with a preferred embodiment, the reinforcement system comprises a frame structure which adapted to be mounted on the surface of an associated highway barrier. The reinforcement system also comprises force distributing means for distributing forces along a horizontal direction upon impact of a vehicle into the associated highway barrier. The distribution of the forces will lessen the degree of force that would otherwise be applied to the highway barrier as a result of the impacting vehicle. The forced distributing means is secured to the frame structure and extends substantially horizontally and parallel to the associated highway barrier and the road surface on which the highway barrier is arranged.

The frame structure of the reinforcement system of the present invention is preferably contoured to substantially follow at least a portion of the surface of the associated highway barrier. In addition to its function of supporting the force distributing means, the frame structure may also serve the function of distributing a portion of the forces away from the point of impact along vertical distribution paths.

In a preferred embodiment, the frame structure comprises a pair of top sections, which may also be considered saddles, which are seated on the top surface of an associated highway barrier. The frame structure may also comprises a pair of side assembles that are connected to the pair of top sections at respective opposite sides of the associated highway barrier. Each of the side assemblies may extend downwardly along the pair of side surfaces toward the bottom surface of the associated highway barrier. It is preferable for the pair of side assembles to be substantially identical. However, in other embodiments, the frame structure of the present invention may only include one side assembly or may include a pair of side assembles wherein the side assembles are not identical to each other. Further, alternate embodiments of the reinforcement system of the present invention may include a single top section as opposed to a pair of top sections.

The frame structure of the present reinforcement system may comprise securing means for securely mounting the frame structure to the associated highway barrier. In a preferred embodiment, the securing means may comprise at least one cable which has a first end connected to one of the side assemblies and a second end connected to the other side assembly. In this preferred embodiment, the cable preferably extends between the first and second side assemblies along the bottom surface of the associated barrier when the reinforcement system is in its assembled position.

It is also preferable for the frame structure of the reinforcement system to include connection means for permitting selective connection and disconnection of the first and second side assemblies to one or more top sections. In a particularly preferred embodiment, the connection means may comprise at least one aligned aperture arranged in the first and second side assemblies and at least one threaded bolt which extends from at least one of the top sections through the at least one aligned aperture. The connection means may also comprise at least one corresponding threaded nut to secure the first and second side assemblies to the at least one top section.

The frame structure may include at least one raised portion which extends outwardly from at least one of the pair of side surfaces of the associated highway barrier at the location where at least one of the first and second side assemblies are connected to the at least one top section. In a particularly preferred embodiment, the at least one raised portion may comprise a pair of raised portions having a substantially inverted u-shaped configuration arranged adjacent to the pair of side surfaces of the associated highway barrier at the location where the first and second side assemblies are connected to the at least one top section.

It also preferable for each of the side assemblies to include at least one bolt which extends outwardly away from the side surfaces of the associated highway barrier so that one or more cables can be releasably connected to the bolts extending from the side assemblies. A pair of corresponding threaded nuts that are mountable on respective ones of the pair of threaded bolts may be provided so that the at least one cable can be selectively secured on the threaded bolts of the first and second side assemblies.

In a preferred embodiment, the force distributing means may comprise at least one hollow pipe attached to at least one of the side assemblies. In another preferred embodiment, the at least one hollow pipe may comprise a plurality of hollow pipes which extend substantially parallel to each other. Each of the hollow pipes may include a first end which defines a female receptacle and a second having a male member extending therefrom. The male member and the female receptacle may have means for forming a releasable connection to a corresponding female receptacle and male member on adjacent pipe sections. In a preferred embodiment, the male member is arranged partially within the second end of the corresponding pipe and extends partially beyond the second end. In this embodiment the male member is adapted to be connected to a respective one of the female pipe sections.

In another preferred embodiment, the male member includes a slot which defines a passageway through the portion which extends beyond the second end. Each of the female receptacles may include a pair of apertures whereby the apertures are aligned with the slot for placement of a bolt therethrough when the male member is connected to the female receptacle.

In a particularly preferred embodiment of the present invention, the force distributing means is arranged on the frame structure on both sides of an associated highway barrier. In such embodiments, the force distributing means may comprise of a pair of pipes connected to the frame structure on each side of the highway barrier substantially adjacent to the side surfaces thereof. Each of the pair of pipes include a lower pipe secured to the frame structure at a location selected for impact with the tires on most vehicles upon impact of a vehicle into the associated highway barrier. An upper pipe is also included on each side of the highway barrier which is spaced apart from the lower pipe so that a trap zone is set up wherein the front bumper on most vehicles will impact the associated highway barrier, if at all, between the lower and upper pipes.

In accordance with a further aspect of the present invention, a method of assembling a reinforcement system on highway barriers is disclosed. The reinforcements system preferably includes the structure of the reinforcement system set forth above and may have a modular frame structure including a plurality of components such as at least top section and at least one side assembly. In accordance with one method of assembling such a reinforcement system, the at least one top section may be arranged on a top surface of an associated highway barrier. The at least one side assembly may be connected to the at least one top section so that it extends downwardly along a side wall of the associated highway barrier. The at least one side assembly may then be secured to the at least one top section to stabilize the frame structure with respect to the associated highway barrier.

When the reinforcement system comprises first and second side assemblies, the method of assembling the system on highway barriers may comprise the steps of arranging at least one top section on the top surface of an associated highway barrier and then connecting the first side assembly to the at least one top section so that the first side assemble extends downward along a side wall of the associated highway barrier. The second side assembly may then be connected to the at least one top section at the location opposing the connection of the at least one top section and the first side assembly so that the second side assembly extends downwardly along an opposing side wall of the associated highway barrier. In accordance with this method of the present invention, the first and second side assemblies may then be secured to each other so that the frame structure is stabilized on the associated barrier. The steps of connecting the first and second side assemblies to the at least one top section may comprise aligning apertures which extend through the first and second side assemblies with threaded bolts which extend from the at least one top section. Thereafter, the first and second side assemblies may be hung on the at least one top section so that the threaded bolts extend through the aligned apertures.

The steps of securing the first and second side assemblies to the at least one top section may comprise placing a corresponding nut of each of the threaded bolts and tightening the corresponding nuts.

In a preferred embodiment wherein the side assemblies of the frame structure include horizontally arranged pipes secured to vertically arranged support members, if is preferable to connect the horizontally arranged pipes to adjacent horizontal pipes of reinforcement systems arranged on adjacent highway barriers to form a continuous system. In this embodiment, a preferred method of assembling the reinforcement system may comprise the steps of placing substantially flat elongated members which extend from the second end of a first set of pipes within corresponding aligned female receptacles arranged at a second end of a second set of pipes so that the slotted passage way of the flat elongated member is in alignment with transversely arranged aligne apertures. Threaded bolts may then be placed through the aligned apertures on the slots and corresponding threaded nuts may be placed on the threaded bolt to completely assembly of the system.

In accordance with a preferred method of assembling a reinforcement system on highway barriers, the step of securing the first and second side assemblies together may comprise attaching at least one cable between the first and second side assemblies so that the at least one cable extends along the bottom surface of an associated highway barrier.

Accordingly, it is an object of the present invention to provide a reinforcement system and a method of assembling such a system on associated highway barriers wherein the reinforcement system provides additional strength to the highway barriers on which they are placed.

It is another object of the present invention to provide a reinforcement system which will distribute forces which may occur due to the impact of a vehicle into the reinforcement system away from and along an associated highway barrier so that the effectiveness of a highway barrier system is enhanced.

The above summary, as well as further objects, features and advantages of the present invention will be more fully understood when considered in conjunction with the following detailed description of a preferred embodiment of a reinforcement system when taken in conjunction with the figures disclosing the present invention.

DETAILED DESCRIPTION OF THE PREFERRED EMBODIMENTS

In accordance with a preferred embodiment of the present invention, a reinforcement system 24 is generally shown in FIGS. 1–10 for use in connection with a highway barrier system 10. Although the present reinforcement system 24 can be used with various types of highway barriers, one particular type of highway barrier that can be used with the reinforcement system 24 is marketed by Safety Barrier Systems of Wilkes-Barre, Pa. under the trademark GUARDIAN. The GUARDIAN barrier system includes a plurality of polyethylene energy-absorbing longitudinal barriers that obtain increased strength and weight when filled with a fluid. The particular structure of such barriers is disclosed in U.S. Pat. Nos. 5,123,773; 4,946,306; and 4,773,629 to Yodock, the subject matter of which is incorporated by reference herein.

The present reinforcement system 24 is particularly well suited for use with portable highway barriers, as it comprises few components that are easily assembled and disassembled on associated highway barriers in the field, such as highway barrier 14. It should be appreciated, however, that the modularity and portability aspect is an optional feature of the present invention as the reinforcement system 24 can also be used in connection with permanent highway barriers.

Figure 1:
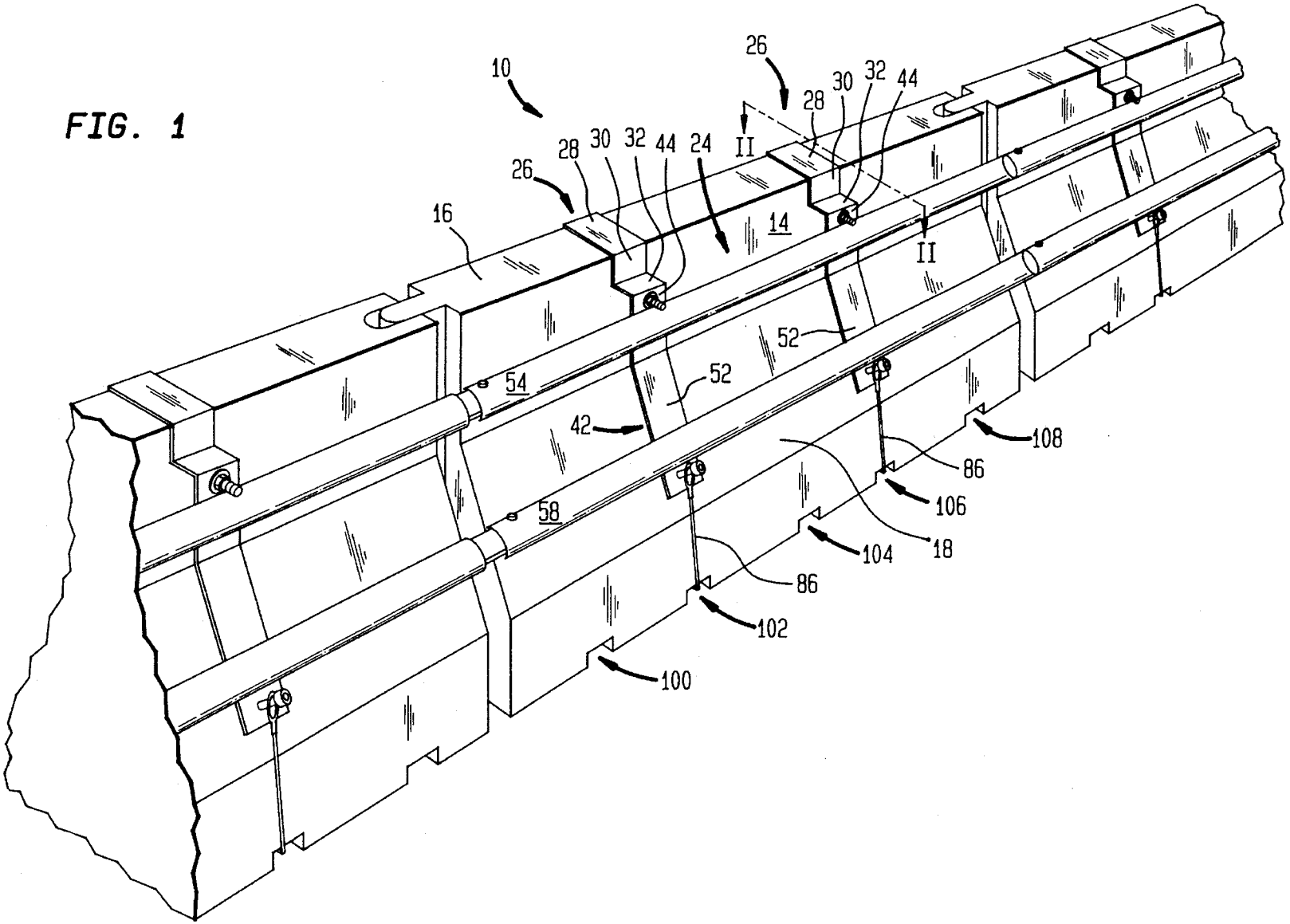
FIG. 1 is a perspective view of a highway barrier system including the reinforcement system of the present invention.
Figure 3:
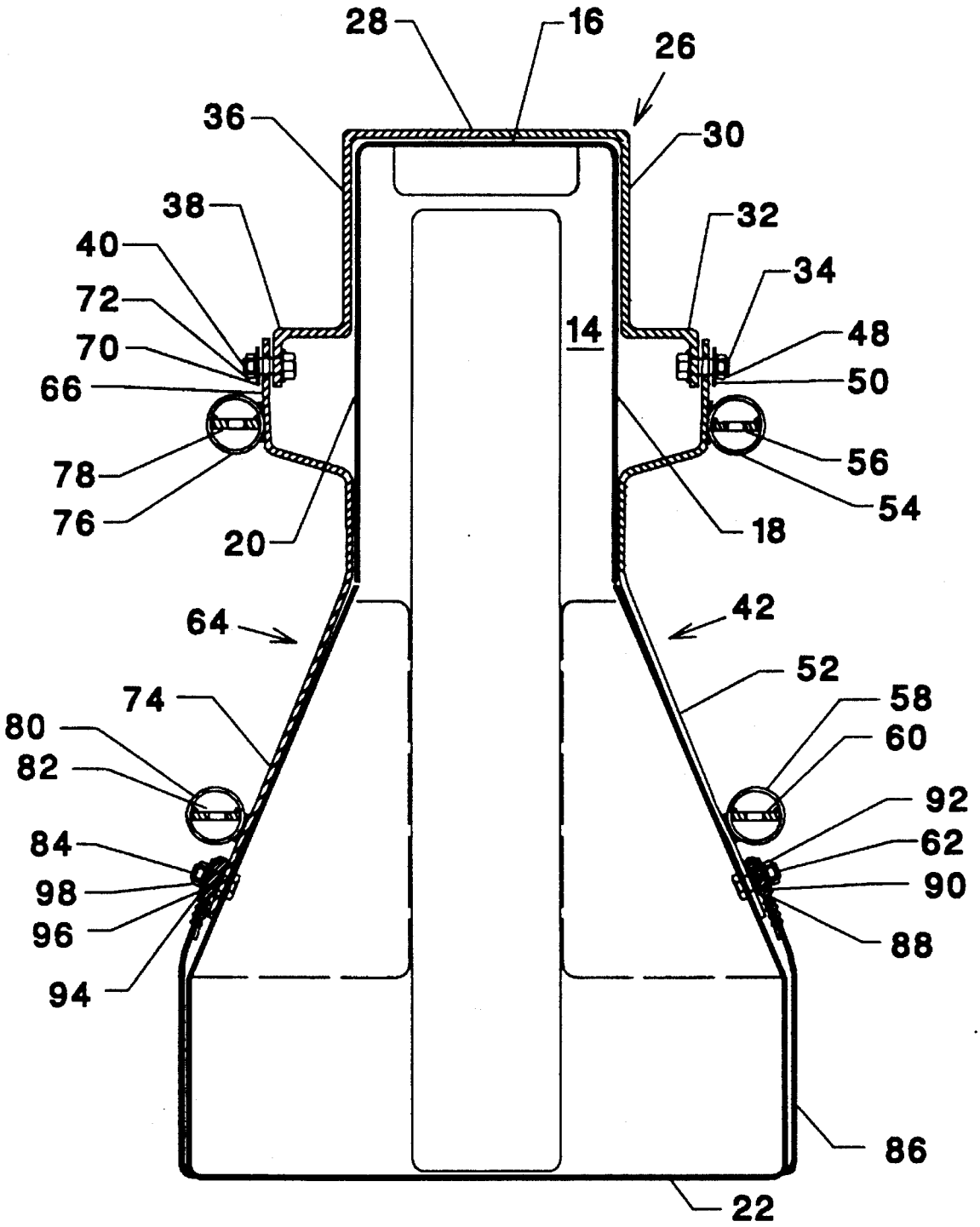
FIG. 3 is a cross-sectional side view of the reinforcement system shown in FIG. 2 mounted on an associated highway barrier.

As clearly disclosed in FIGS. 1 and 3, a highway barrier system 10 comprises a plurality of highway barriers 14. Each of the highway barriers 14 include a top surface 16, opposing front and rear surfaces 18 and 20, and a bottom surface 22. The bottom surface 22 is shown in FIGS. 1 and 3 as being wider than top surface 16 as it forms a stable base for the highway barrier 14 when placed in assembled position on the surface of a highway or other road.

The reinforcement system 24 is preferably made of a sturdy rigid material that is sufficient to absorb forces which may occur due to impact of a vehicle into the reinforcement system 24 and an associated highway barrier 14 on which the reinforcement system is mounted. In a preferred embodiment, steel may be used as a primary component of the reinforcement system 24. However, various metals and metal alloys may be used in alternate embodiments to manufacture the reinforcement system 24. Further, other materials such as polyethylene, rubber, and the like may also be used to form the reinforcement system 24.

Figure 2:
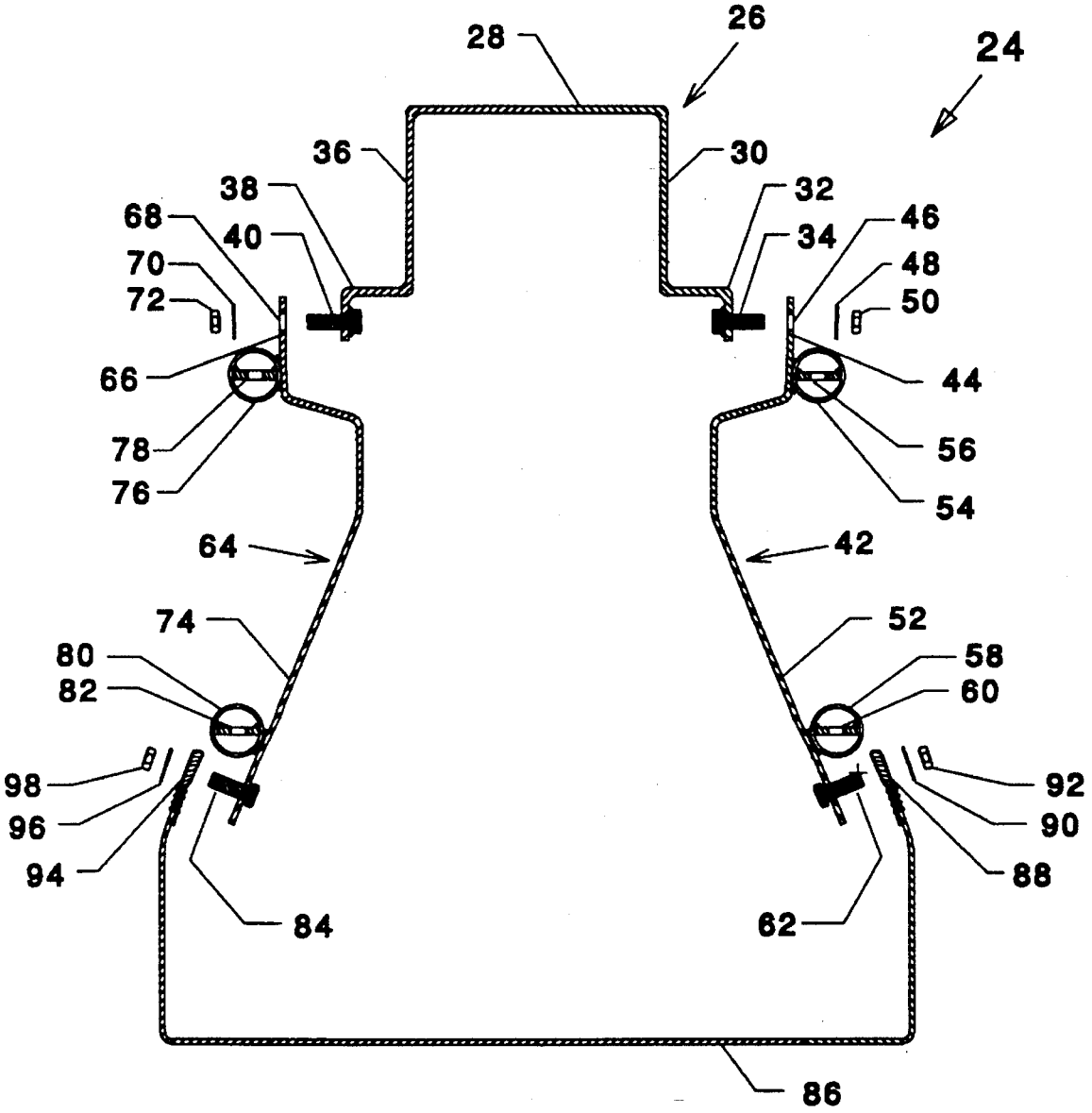
FIG. 2 is an exploded cross-sectional side view of the reinforcement system of the present invention taken along line II—II.

The particular structure of the reinforcement system 24 is clearly shown in FIGS. 1–10. In particular, the reinforcement system 24 includes a pair of identical top sections 26 which may be considered saddles as they are adapted to be mounted on the top surface 16 of the barrier 14. As with the other components of the reinforcement system 24, the top sections 26 include various portions that may be sized and shaped to correspond with the surface contour of the associated highway barrier 14. Since each of the top sections 26 are identical, it should be appreciated that any reference herein to a component or portion of one of the top sections will apply equally to the other top section. With this in mind, FIGS. 1–3 show that each of the top sections 26 include a central seat portion 28. FIGS. 1 and 3 clearly show the central seat portions 28 in their mounted position adjacent the top surface 16 of the barrier 14.

A pair of downwardly extending portions 30 and 36 are integrally connected to the central seat portion 28 at opposing ends. When placed in assembled position, the downwardly extending portions 30 and 36 are intended to extend along opposing front and rear surfaces 18 and 20 of the barrier 14 toward the bottom surface 22 thereof.

L-shaped connecting portions 32 and 38 are integrally connected to the lower end of respective downwardly extending portions 30 and 36. As best shown in FIGS. 1–4, each side of the top sections 26 include a pair of corresponding connecting bolts 34 and 40 which extend through the L-shaped connecting portions 32 and 38. The connecting bolts 34 and 40 may be integrally welded to the top sections 26 or may be removably inserted through apertures (not shown) in respective L-shaped connecting portions 32 and 38.

The size and shape of the top sections 26 may vary depending upon the particular barrier on which they are mounted. In the preferred embodiment shown in FIGS. 1–10, the top sections 26 may be made of substantially flat steel bars having a thickness of approximately 5/16 of an inch, and a width of approximately three inches. The length of different portions of the top sections 26 may also vary in different embodiments. In one preferred embodiment, the length of the central seat portions 28 may have an inner dimension of approximately 10.25 inches. The downwardly extending portions 30 and 36 may have a length of approximately 8.12 inches. The downwardly extending length of the L-shaped connecting portions 32 and 38 may be about 2.13 inches. The length of the L-shaped connecting portions 32 and 38 which extends outwardly from the respective downwardly extending portions 30 and 36 may be about seven inches.

The reinforcement system 24 includes a pair of identical pipe assemblies 42 and 64 which are adapted to be mounted on the bolts 34 and 40 respectively, of the top sections 26. The size and shape of the pipe assemblies 42 and 64 are illustrated in FIGS. 1, 2, 3, 5, 9 and 10 as corresponding to the contoured front surface 18 and rear surface 20 of an associated highway barrier 14.

Figure 5:
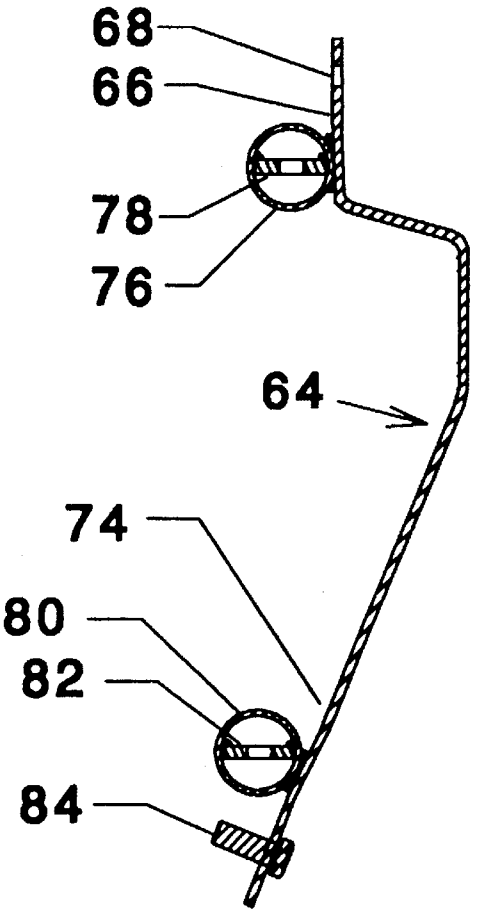
FIG. 5 is an isolated cross-sectional side view of a pipe assembly side section of the reinforcement system shown in FIG. 2.
Figure 4:
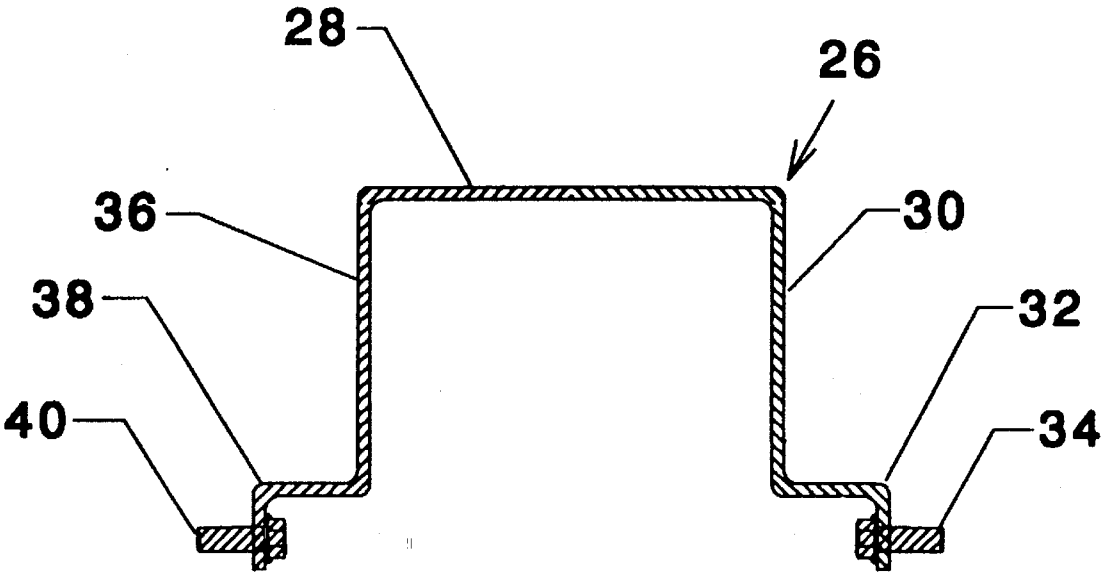
FIG. 4 is an isolated cross-sectional side view of the top section of the reinforcement system shown in FIG. 2.

As best shown in FIGS. 2, 3 and 5, the front and rear pipe assemblies 42 and 64 are identical to each other. However, in an embodiment where the associated highway barrier has one flat side and one contoured side, the rear pipe assembly may not be identical to the front pipe assembly. In fact, in such an embodiment, it may not be necessary for the reinforcement system 24 to include any rear pipe assembly whatsoever. In this regard, the front pipe assembly 42 may be connected to the top sections 26 at the upper ends thereof. The lower end of the front pipe assembly 42 may be directly connected to the rear side of the top section 26 by means of a pair of cables, such as cables 86 which will be described in more detail below.

The front and rear pipe assemblies 42 and 64 are substantially elongate flattened bars. In a preferred embodiment, pipe assemblies 42 and 64 may be 5/16 of an inch thick, 3 inches wide and about 23 inches long. Of course, the dimensions of the pipe assemblies 42 and 64 may vary depending upon the size and shape of the associated highway barrier on which they are mounted.

As shown in FIGS. 1, 2, 3 and 5, front pipe assembly 42 includes a pair of upper ends 44 each of which has an aperture 46 arranged therein to accommodate mounting of the pipe assembly 42 on a pair of bolts 34. A pair of corresponding washers 48 and threaded nuts 50 may be used to secure the pipe assembly in assembled position on the respective bolts 34.

The front pipe assembly 42 also includes a pair of outwardly slanted lower ends 52 that are preferably tapered at an angle substantially equivalent to the tapered angle of associated highway barrier 14. A pair of pipes 54 and 58 may be welded to the upper portion 44 and the lower portions 52 of the front pipe assembly 42. As clearly illustrated in FIGS. 1, 8 and 10, the upper pipe 54 and the lower pipe 58 extend horizontally and are substantially parallel to each other.

In order to connect adjacent highway barriers to each other to form a continuous highway barrier system 10, the upper pipe 54 and the lower pipe 60 are provided with connecting means at each of the ends thereof for connection to adjacent horizontally arranged upper and lower pipes of an adjacent pipe assembly that is mounted on an adjacent highway barrier. To this end, each of the upper and lower pipes are substantially hollow and have a first end of which forms a female receptacle.

Figure 10:
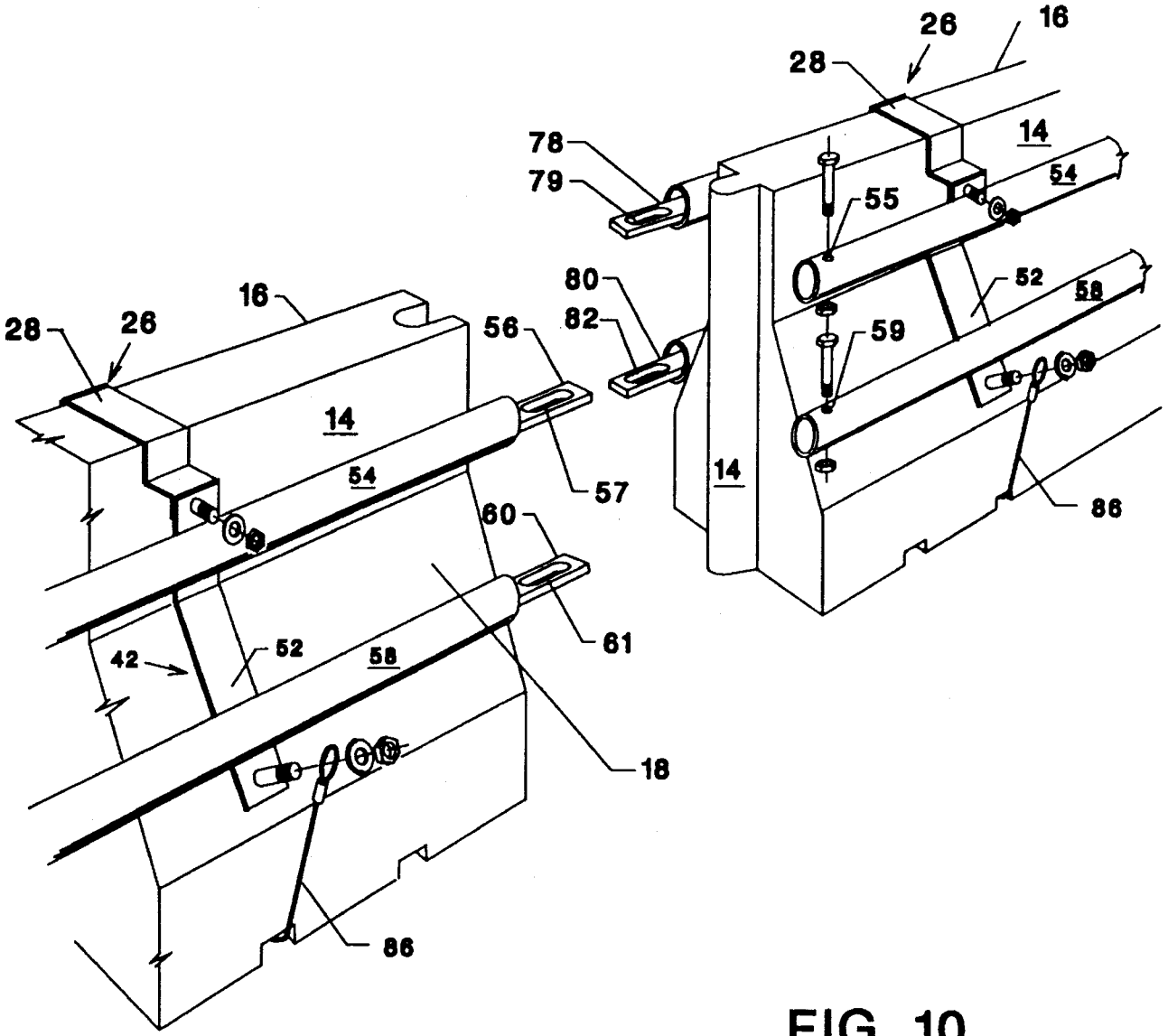
FIG. 10 is a perspective partially exploded view of a highway barrier system showing the interconnecting relationship of pipe assemblies of adjacent highway barriers.

As shown in FIG. 10, a pair of apertures designated 55 and 59 are arranged on the upper pipe 54 and the lower pipe 58 at the female receptacle ends thereof. The opposite ends of the upper pipe 54 and the lower pipe 58 includes substantially flat elongate bars 56 and 60, respectively. Each of the elongate bars 56 and 60 are mounted partially within corresponding pipes 54 and 58. As best shown in FIGS. 2 and 3, the elongate bars 56 and 60 may be permanently welded to the inner diameter walls of corresponding pipes 54 and 58. Each of the elongate bars 56 and 60 also extend partially outside of the pipes 54 and 58. The portion of the elongate bar 56 which extends beyond the end of upper pipe 54 includes a slot 57 which defines a passageway through the elongate bar 56. Similarly, the portion of the elongate bar 60 which extends beyond the end of the lower pipe 58 includes a slot 61 therein which defines a passageway. When the elongate flat bars 56 and 60 are arranged within the female receptacle end of associated upper and lower pipes of a pipe assembly mounted on an adjacent highway barrier, the slots 57 and 61 are placed in alignment with apertures 55 and 59 so that bolts and corresponding nuts can secure adjacent pipe assemblies to each other.

In a preferred embodiment, the elongate flat bars 56 and 60 may extend approximately three inches within associated pipes 54 and 58. In order to securely mount the elongate flat bars within the associated pipes, the elongate flat bars 56 and 60 may be welded, as noted above, within respective pipes 54 and 58. Each of the flat bars 56 and 60 may extend approximately five inches out of the corresponding pipes 54 and 54 to form a male connection for extension into an adjacent pipe. The slots 57 and 61 within the flat pipes 56 and 60 may be approximately one to four inches long and approximately ¾ of an inch wide. Although the particular size and shape of the slots 57 and 61 may vary, the slots should be appropriately sized to allow for tolerancing errors when connecting the elongate flat bars 56 and 60 with adjacent pipe assemblies. When the reinforcement system 24 is in assembled position on associated highway barriers 14, it is interconnected to adjacent reinforcement systems and highway barriers to form a continuous highway barrier system 10 as shown in FIG. 1.

The upper pipe 54 and the lower pipe 58 may be permanently welded to the upper portion 44 and the lower portion 52 of the pipe assembly 42. However, in alternate embodiments, the upper and lower pipes 54 and 58 may be removably connected to their respective locations on the pipe assembly 42.

As clearly illustrated in FIGS. 1–3 and 5, a pair of bolts 62 and 84 are arranged near the lower most end of the front pipe assembly 42. The bolts may be permanently secured to the first pipe assembly 42 or may be removably inserted within corresponding apertures (not shown). The function of the bolts 62 and 84 are to facilitate the connection of the front pipe assembly 42 to the rear pipe assembly 64 as will be discussed further below.

Figure 9:
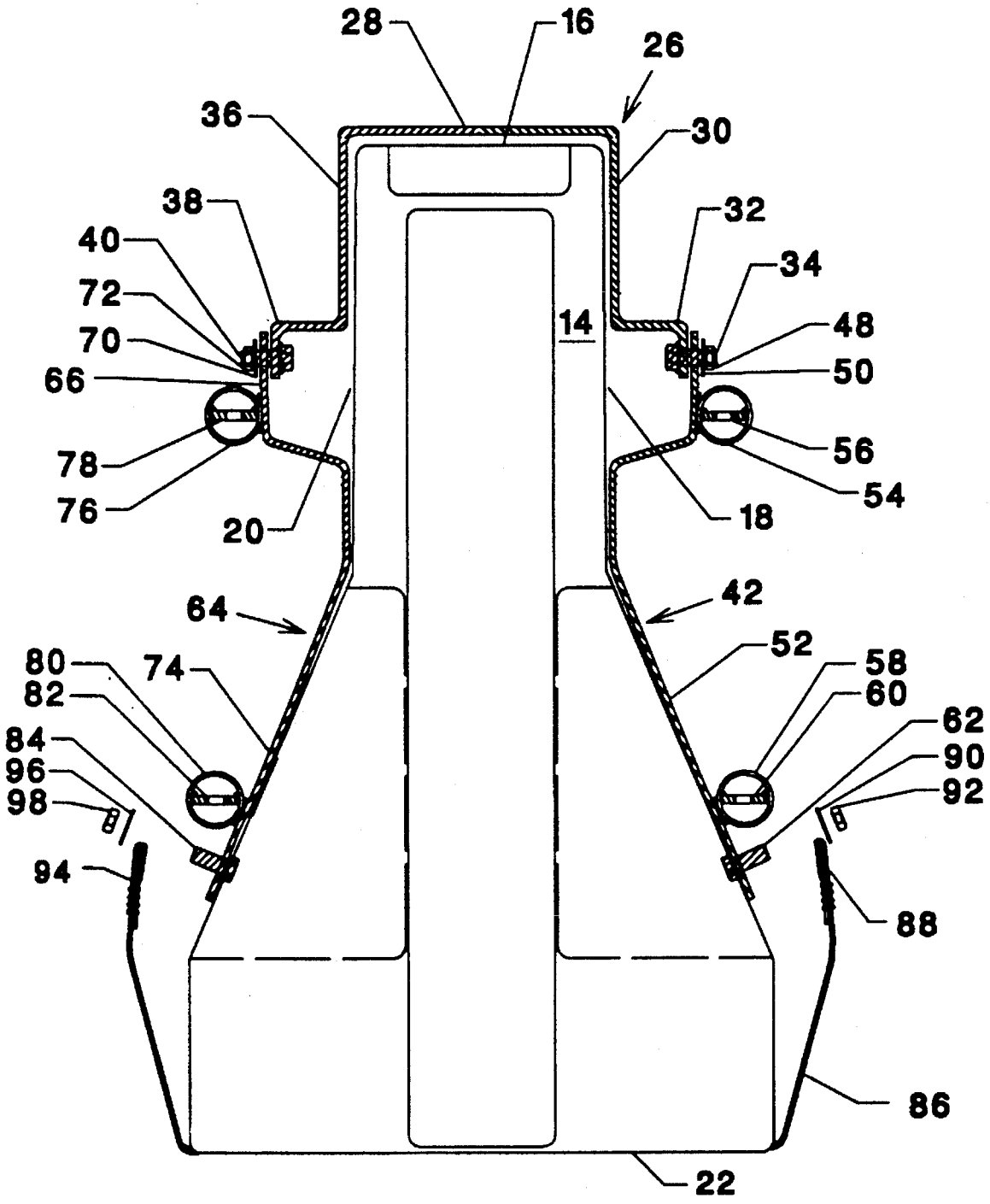
FIG. 9 is a side view of a highway barrier showing attachment of cables to the pair of side pipe assemblies of the reinforcement system in accordance with the method of the present invention.

As indicated above, and shown in FIGS. 2, 3 and 9, the front pipe assembly 42 and the rear pipe assembly 64 are identical to each other. In particular, the rear pipe assembly 64 includes a flat bar section having a pair of upper ends 66 and a pair of outwardly tapered lower ends 74. Each of the upper ends 66 includes an aperture 68 therein for mounting the pipe assembly 64 on corresponding bolts 40 of the top sections 26. Corresponding washers 70 and threaded nuts 72 are used to secure the rear pipe assembly 64 in assembled position to the pair of identical top sections 26.

The rear pipe assembly 64 also includes an upper pipe 76 having an elongate flat bar 78 extending partially within the upper pipe 76 and extending partially past one end thereof. The upper pipe 76 may be welded, or removably connected, to the pair of upper ends 66 of the second pipe assembly 64. A lower pipe 80 is connected at a preselected location on the pair of outwardly slanted lower ends 74 and includes an elongate flat bar 82 extending therefrom. The elongate flat bars 78 and 82 may be permanently welded to the inner diameter walls of corresponding pipes 76 and 80, as best shown in FIGS. 2 and 3. A pair of bolts 84 are mounted, either permanently or removably, near the lower most ends of the rear pipe assembly 64.

A pair of cables 86 may be used to mount the reinforcement system 24 in assembled position on an associated highway barrier 14. As can be best appreciated from the disclosure in FIGS. 1–3, 9 and 10, the cables 86 may be used to connect the lower portions of the front pipe assembly 42 and the rear pipe assembly 64 to each other.

Each of the cables 86 include a first end and a second end. A pair of eyelets 88 and 94 are attached to the respective first and second ends of the cables 86. Each of the eyelets 88 and 94 may comprise a steel loop that is sized and shaped to fit over corresponding bolts 62 and 84 which extend from the lower portions of the front pipe assembly 42 and the rear pipe assembly 64. In assembled position, the eyelets 88 are placed on corresponding bolts 62 and the pair of cables 86 are arranged along the bottom portion of the front surface 18 of the highway barrier 18 and extends across the bottom surface 22. The cables 86 continue to extend along the bottom portion of the rear surface 20 of the barrier 14 and terminate with mounting of the eyelets 94 on corresponding bolts 84. To aid in this arrangement, the associated highway barrier 14 may have aligned grooves 100–108 which extend across the width of the bottom surface 22 between the front surface 18 and the rear surface 20. As shown in FIG. 1, the cables 86 extend along grooves 102–106 so that the bottom surface 22 of the barrier 14 sits flush against the road surface and so that the cables 86 will not be crushed between the bottom surface 22 of the associated highway barrier 14 and the road surface on which the highway barrier is placed. The cables 86 and the eyelets 88 and 94 thereon may be made of various materials and sizes. In one preferred embodiment the cables 86 and the eyelets 88 and 94 may be permanently assembled from 3/16 inch diameter seven by nineteen strand full compliance galvanized aircraft cable that are vinyl coated for additional corrosion protection and may include galvanized thimbles and plated compression sleeves.

In order to complete the mounting of the reinforcement system 24 on the associated highway barrier 14, a pair of washers 90 and 96 and corresponding threaded nuts 92 and 98 are used to retain the eyelets 88 and 94 on associated bolts 62 and 84. When the cables 86 are in assembled position of the front and rear pipe assemblies 42 and 64, the tension therein is sufficient to hold the reinforcement system 24 tightly in assembled position on an associated barrier 14.

In its final assembled position, the location of the upper pipes 56 and 76 and the lower pipes 58 and 80 of the pipe assemblies 42 and 64 are selected so that forces which may occur during the impact of a vehicle into a highway barrier will be quickly distributed and transferred away from the particular highway barriers 14 of which the reinforcement system 24 is mounted. In particular, the forces are transmitted horizontally along the upper and lower pipes such as upper pipe 54 and lower pipe 58 on the front pipe assembly 42. The forces are also transmitted along the vertical sections of the frame formed by the front pipe assemblies 42, the top sections 26 and the interconnected rear pipe assemblies 64. Further, the particular structure and arrangement of the reinforcement system 24 permits forces to be spread out among adjacent highway barriers, instead of being concentrated on the particular highway barrier that a vehicle may strike.

The spacing between the pipes, such as upper and lower pipes 54 and 58 and 76 and 80 is selected to accommodate a majority of vehicles and to maximize force transfer and distribution from a vehicle so that the forces are not concentrated at a particular location on an associated highway barrier 14. In this regard, placement of the lower pipe should be such that the tires on most vehicles would hit the lower pipe upon impact of a vehicle into an associated highway barrier 14. In particular, the lower pipes 58 and 80 may be arranged at an elevation of between about ten to twenty inches above the road surface. In a preferred embodiment, the distance between the center of the lower pipe 58 and the road surface may be approximately fourteen inches. Further, placement of the upper pipe should be such that the bumper on most vehicles would become trapped between the parallel upper and lower pipes upon impact of a vehicle into an associated highway barrier 14 so that a striking vehicle will be prevented from climbing over the barrier. The distance between the center of the lower pipe 58 and the upper pipe 54 is preferably between about ten and twenty inches and in a particularly preferable embodiment may be approximately sixteen inches. It should be appreciated that the above described spacing between the pipes and the locations of the pipes with respect to the road surface may vary in alternate embodiments while still performing the desired function of the present invention.

The reinforcement system 24 and the GUARDIAN barriers on which the reinforcement system may be mounted is particularly well suited to serve as a temporary barrier system. The temporary nature of such a barrier system is possible due to the portability aspect of the GUARDIAN barrier system and the modular components of the reinforcement system of the present invention. Since the reinforcement system 24 is designed to be quickly and easily assembled in the field by construction personnel, each of the components thereof may be light enough to permit one or two construction workers to easily assemble the reinforcement system 24 on an associated barrier at a construction site or other desired location.

Although the specific structure of the reinforcement system 24 has been described above as including a pair of top sections 26 and a pair of pipe assemblies 42 and 64 in combination with a pair of connecting cables 86, it should be appreciated that the number of components may vary in alternate embodiments. For example, it may be desirable in alternate embodiments to interconnect the pair of top sections 26 (which may also be described as saddles) by one or more connecting bars which may be permanently or removably connected to the pair of top sections 26 so that the top sections 26 are maintained at a predetermined spaced distance from each other. In other embodiments, the reinforcement system may only have a front pipe assembly without a rear pipe assembly. As indicated above, in such an embodiment the top of the front pipe assembly would be mounted on the bolts 34 which extend from the pair of top sections 26 and the lower ends of the front pipe assembly 42 may be connected to the bolts 40 which extend from the opposite side of the top sections 26 by means of the cables 86, or other connecting means. Such an embodiment may be desired where only one side of the barrier system will face moving vehicles.

Figure 7:
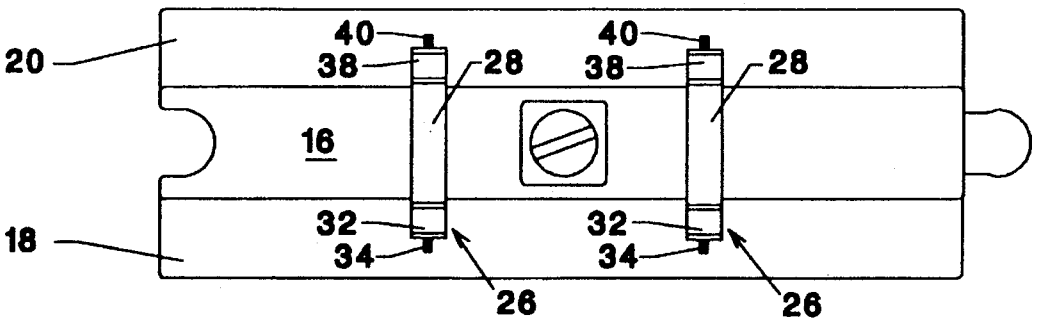
FIG. 7 is a top view of the highway barrier shown in FIG. 6.
Figure 6:
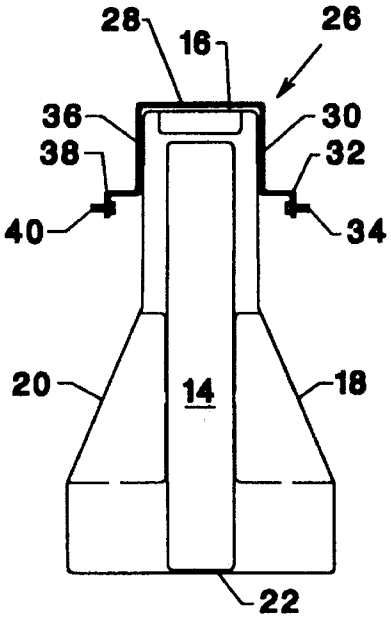
FIG. 6 is a side view of a highway barrier having the top section of the present reinforcement system placed thereon in accordance with a first step of assembling the reinforcement system of the present invention on highway barriers.

With the foregoing variations of the structure of the reinforcement system 24 in mind, the method of assembling the present reinforcement system 24 on associated highway barriers is as follows. Initially, two saddles or top sections 26 should be placed on the top surface 16 of associated highway barrier 14 at predetermined distances from each other. Where the associated highway barrier 14 is a GUARDIAN barrier, the two top saddles should be aligned with the second and fourth grooves which extend along the bottom surface 22 of the associated highway barrier 14. As shown in FIG. 1, the second groove is designated by reference numeral 102 and the fourth groove is designated by reference numeral 106. FIGS. 6 and 7 depict a side view and top view, respectively, of an associated highway barrier 14 after a pair of saddles 26 have been placed thereon in assembled position in accordance with the first step of the method of the present invention.

After the saddles 26 are placed in assembled position, the front pipe assembly 42 should be placed in its mounted position on the bolts, such as bolts 34 which extend from the L-shaped connecting portions 32 of the saddles 26. At this time, the front pipe assembly 42 should be adjacent the front surface 18 of the associated highway barrier 14. After the front pipe assembly 42 is mounted on the saddles 26, the upper pipe 54 will be arranged at a spaced location from the front surface 18 of the associated highway barrier 14.

Figure 8:
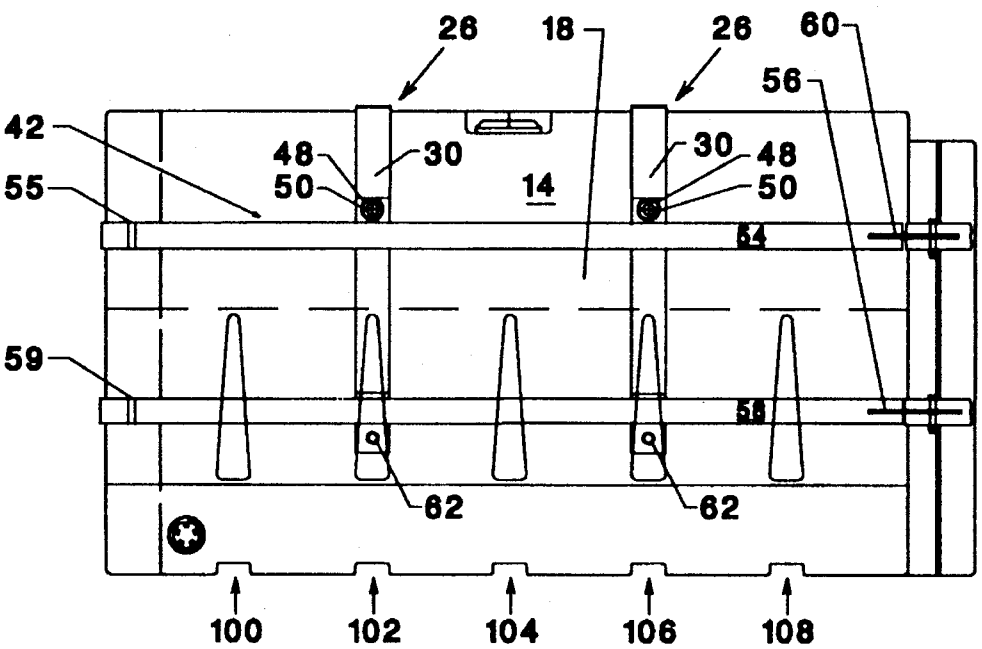
FIG. 8 is a front view of a highway barrier showing a side pipe assembly assembled to identical top sections in accordance with a second step of the method of assembling a reinforcement system on highway barriers.

The rear pipe assembly 64 should then be mounted on the opposite side of the saddles 26 on bolts 40 which extend from the L-shaped connecting portions 38. The front and rear pipe assemblies 42 and 64 should then be secured to the saddles 26 by placing the associated washers 48 and 70 and nuts 50 and 72 on the corresponding mounting bolts 34 and 40. When this step of the method of the present invention is completed, the front of the associated highway barrier 14 should appear as shown in FIG. 8.

In order to interconnect adjacent highway barriers 14 and reinforcement system 24 so that a continuous highway barrier system 10 is formed, the adjacent highway barriers 14 may be interconnected as discussed in U.S. Pat. Nos. 5,123,773; 4,946,306; and 4,773,629, the disclosure of which has been incorporated by reference herein. The method of the present invention contemplates interconnecting adjacent pipe assemblies so that the flat elongate bars 56 and 60 which extend out of the upper pipe 54 and the lower pipe 58, respectively, are secured within the female receptacle end of adjacently arranged upper and lower pipes. This may be accomplished by placing bolts through aligned apertures 55 and the slot 57 of the upper pipe and securing the bolt thereon by a washer and a nut. Similarly, the lower pipe 54 may be secured to an adjacent lower pipe by arranging the lower flat elongate bar 60 within the female receptacle portion of an adjacent lower pipe so that the slot 61 is in alignment with apertures 59. A bolt is then inserted through the aligned apertures 59 and slot 61 and is secured in place by a washer and a nut.

In accordance with a further step of the method of the present invention, a pair of cables such as cable 86 are attached to the lower bolts 62 and 84 of the front and rear pipe assemblies 42 and 84. This may be accomplished by placing the eyelets 88 on the lower bolts 62 while feeding the cable through the grooved passageways 102 or 106 so that the cables 86 may be pulled taught against the lower surface 22 of an associated highway barrier 14. The eyelet 94 on the opposite end of the cables 86 may then be placed on the bolts 84. The eyelets 88 and 94 may then be secured on their respective bolts 62 and 84 by means of associated washers 90 and 96 and nuts 92 and 98 as discussed above.

When the reinforcement system is entirely assembled so that a continuous barrier system 10 is formed, the strength provided to the barrier system 10 is far superior than existing barrier systems. In this regard, tests which have been performed on the barrier system 10 involve crashing a ¾ ton pick-up truck and a subcompact car into a line of barriers at a speed of approximately forty-five miles per hour and angles of twenty-five degrees and twenty degrees, respectively. These tests were performed at the independent testing facilities of the Texas Transportation Institute, a division of Texas A&M University. The barriers used in these crash tests were commercially available GUARDIAN barriers, which were modified to include the interconnected exterior steel pipe safety reinforcement system 24 of the present invention which was attached to both sides of the barriers in order to protect the barrier line.

In both tests, the vehicles were easily redirected out of the crash zone. Lateral movement of the line of barriers was well less than what had been expected if the barriers did not include the reinforcement system 24 of the present invention. The safety data collected, including ride-down acceleration (deceleration) forces in both the truck and the car tests, was particularly favorable.

While the foregoing description and the accompanying figures are directed toward preferred embodiments of the present invention, it should be appreciated that numerous modifications can be made to the structure and components of the reinforcement system 24 and in the method of assembling the same. Indeed, such modifications are encouraged to be made in the materials, structure, arrangement and steps of the disclosed embodiments and methods of the present invention without departing from the spirit and scope of the present invention. Thus, the foregoing description of the preferred embodiments and steps of the preferred method should be taken by way of illustration rather than by way of illustration as the present invention is defined by the claims set forth below.

We claim:

1. A reinforcement system comprising:

a frame structure mountable on a surface of an associated highway barrier, said frame structure comprising at least one side assembly; and force distributing means for distributing forces along a substantially horizontal direction upon impact of a vehicle into the associated highway barrier so as to lessen the degree of force applied to the associated highway barrier, said force distributing means comprising at least one hollow pipe secured to said at least one side assembly of said frame structure and extending substantially horizontally and parallel to the associated highway barrier and the road surface on which the highway barrier is arranged.

2. The reinforcement system of claim 1 wherein said frame structure is contoured to substantially follow at least a portion of the surface of the associated highway barrier.

3. The reinforcement system of claim 1 wherein the associated highway barrier includes a top surface, a bottom surface spaced from said top surface, and a pair of side surfaces, said frame structure comprising at least one top section seated on said top surface of said associated highway barrier and first and second side assemblies connected to said at least one top section at respective opposite sides of the associated highway barrier, said first and second side assemblies extending downwardly along said pair of side surfaces toward said bottom surface of the associated highway barrier.

4. The reinforcement system of claim 3 wherein said first and second side assemblies are substantially identical.

5. The reinforcement system of claim 3 wherein said frame structure further comprises securing means for securely mounting said frame structure to the associated highway barrier.

6. The reinforcement system of claim 5 wherein said securing means comprises at least one cable having a first end connected to said first side assembly and a second end connected to said second side assembly, said at least one cable extending between said first and second side assemblies along said bottom surface of the associated highway barrier.

7. The reinforcement system of claim 3 wherein said frame structure includes connection means for permitting selective connection and disconnection of said first and second side assemblies to said at least one top section.

8. The reinforcement system of claim 7 wherein said connection means comprises at least one aligned aperture arranged in said first and second side assemblies, at least one threaded bolt extending from said at least one top section for connection through said at least one aligned aperture and at least one corresponding threaded nut adapted be secured on said at least one threaded bolt.

9. The reinforcement system of claim 7 wherein said frame structure includes at least one raised portion extending outwardly from at least one of said pair of side surfaces of the associated highway barrier at the location where at least one of said first and second side assemblies are connected to said at least one top section.

10. The reinforcement system of claim 9 wherein said at least one raised portion extending outwardly from at least one of said pair of side surfaces comprises a pair of raised portions having a substantially inverted U-shaped configuration arranged adjacent said pair of side surfaces at the location where said first and second side assemblies are connected to said at least one top section.

11. The reinforcement system of claim 6 wherein said first and second side assemblies include a pair of bolts extending outwardly away from the side surfaces of the associated highway barrier, so that said at least one cable can be releasably connected to said pair of bolts.

12. The reinforcement system of claim 11 further comprising a pair of threaded nuts mountable on respective ones of said pair of threaded bolts whereby said at least one cable can be selectively secured on said threaded bolts of said first and second side assemblies.

13. The reinforcement system of claim 3 wherein said force distributing means comprises at least one hollow pipe attached to said first and second side assemblies.

14. The reinforcement system of claim 13 wherein said at least one hollow pipe comprises a plurality of hollow pipes extending substantially parallel to each other.

15. The reinforcement system of claim 14 wherein each of said plurality of hollow pipes includes a first end defining a female receptacle and a second end having a male member extending therefrom, said male member and female receptacle having means for forming a releasable connection to a corresponding female receptacle and male member on adjacent pipe sections.

16. The reinforcement system of claim 15 wherein said male member is arranged partially within said second end and partially extends beyond said second end, said male member being adapted for connection to a respective one of said female pipe sections.

17. The reinforcement system of claim 16 wherein said male member includes a slot defining a passageway through the portion extending beyond said second end, each of said female receptacles including a pair of apertures whereby said pair of apertures are aligned with said slot for placement of a bolt therethrough when said male member is connected to said female receptacle.

18. A reinforcement system comprising:

a frame structure including a plurality of modular sections mountable on an associated highway barrier having a top surface, a bottom surface and a pair of side surfaces;

force distributing means for distributing forces along a horizontal direction upon impact of a vehicle into the highway barrier so as to distribute forces which would otherwise be concentrated at a location on the associated highway barrier, said force distributing means comprising a plurality of pipes secured to said frame structure and extending substantially horizontally and parallel to each other, said associated highway barrier and the road surface on which said highway barrier is arranged, said plurality of pipes comprising at least two spaced apart pipes arranged substantially adjacent each of the side surfaces of said associated highway barrier.

19. The reinforcement system of claim 18 wherein said at least two spaced apart pipes comprises a pair of pipes connected to said frame structure substantially adjacent each of the side surfaces of the associated highway barrier, each of said pair of pipes including a lower pipe secured to the frame structure at a location selected for impact with the tires on most vehicles upon crashing of a vehicle into the associated highway barrier, and an upper pipe spaced from said lower pipe so that most vehicle bumpers will impact the associated highway barrier between said lower and upper pipes.

20. The reinforcement system of claim 18 wherein said plurality of modular sections comprises at least one top section seated on the top surface of the associated highway barrier and first and second side assemblies releasably connected to said at least one top section at respective opposite side surfaces of the associated highway barrier, and said first and second side assemblies extending downwardly along said pair of said surfaces toward the bottom surface of the associated highway barrier.

21. The reinforcement system of claim 20 wherein said frame structure further comprises securing means for securely mounting said frame structure to the associated highway barrier.

22. The reinforcement system of claim 21 wherein said securing means comprises at least one cable having a first end connected to said first side assembly and a second end connected to said second side assembly, said at least one cable extending between said first and second side assemblies along said bottom surface of the associated highway barrier.

23. The reinforcement system of claim 22 wherein said frame structure includes connection means for permitting selective connection and disconnection of said first and second side assemblies to said at least one top section.

24. The reinforcement system of claim 23 wherein said connection means comprises at least one aligned aperture arranged in said first and second side assemblies, at least one threaded bolt extending from said at least one top section for connection through said at least one aligned aperture and at least one corresponding threaded nut adapted be secured on said at least one threaded bolt.

25. A method of assembling a reinforcement system on highway barriers wherein the reinforcement system includes a modular frame structure having a plurality of components including at least one top section and at least one side assembly, said method comprising the steps of:

first arranging said at least one top section on a top surface of an associated highway barrier;

next connecting said at least one side assembly to said at least one top section so that said at least one side assembly extends downwardly along a side wall of the associated highway barrier; and securing said at least one side assembly to said at least one top section to stabilize said frame structure to the associated highway barrier.

26. A method of assembling a reinforcement system on highway barriers wherein the reinforcement system includes a modular frame structure having a plurality of components including at least one top section, and first and second side assemblies, said method comprising the steps of:

first arranging said at least one top section on a top surface of an associated highway barrier;

next connecting said first side assembly to said at least one top section so that said first side assembly extends downwardly along a side wall of the associated highway barrier;

next connecting said second side assembly to said at least one top section at a location opposing said connection of said at least one top section and said first side assembly so that said second side assembly extends downwardly along an opposing side wall of the associated highway barrier; and securing said first side assembly to said second side assembly to stabilize said frame structure on the associated highway barrier.

27. The method of claim 26 wherein the step of arranging said at least one top section on an associated highway barrier comprises the step of placing a pair of substantially identical top sections on the top surface of the associated highway barrier at a predetermined spaced distance from each other.

28. The method of claim 27 wherein said steps of connecting said first and second side assemblies to said at least one top section comprises aligning apertures which extend through said first and second side assembly with threaded bolts extending from said at least one top section and thereafter hanging said first and second side assemblies on said at least one top section so that said threaded bolts extend through said aligned apertures.

29. The method of claim 28 wherein said steps of securing said first and second side assemblies to said at least one top section comprises placing a corresponding nut on each of said threaded bolts and tightening said corresponding nuts.

30. The method of claim 29 wherein said first and second side assemblies of said frame structure include horizontally arranged pipes secured to vertically arranged support members, said pipes being hollow and having a first end configured as a female receptacle and having transversely arranged aligned apertures in opposing sides of said pipes near the first end thereof, said pipes having a second end including a substantially elongate flat member having a slotted passageway arranged therein, said substantially flat elongate member being partially arranged within a corresponding one of said hollow pipes and extending horizontally beyond said second end for insertion within the female receptacle at the first end of aligned horizontally arranged pipes arranged on an adjacent highway barrier, said method further comprising the steps of placing said substantially flat elongate member extending from said second end of a first set of said pipes within corresponding aligned female receptacles of said first end of a second set of said pipes so that the slotted passageway of said flat elongate member is in alignment with said transversely arranged aligned apertures;

placing threaded bolts through said aligned apertures and slots; and securing threaded nuts on corresponding ones of said threaded bolts.

31. The method of claim 30 wherein said step of securing said first and second side assemblies together comprise attaching at least one cable between said first and second side assemblies so that said at least one cable extends along the bottom surface of an associated highway barrier.

32. The method of claim 26 wherein said step of securing said first and second side assemblies together comprise attaching at least one cable between said first and second side assemblies so that said at least one cable extends along the bottom surface of an associated highway barrier.

33. A highway barrier system comprising:

at least one highway barrier having a rigid structure defining a surface;

a frame structure mounted on the surface of said highway barrier; and force distributing means for distributing forces along a substantially horizontal direction upon impact of a vehicle into said highway barrier so as to lessen the degree of force applied to said highway barrier, said force distributing means including at least one hollow pipe secured to said frame structure and extending substantially horizontally and parallel to the surface of said highway barrier and the road surface on which said highway barrier is arranged.

* * * * *